US009117386B2

(12) United States Patent
Lim et al.

(10) Patent No.: US 9,117,386 B2
(45) Date of Patent: Aug. 25, 2015

(54) METHOD FOR DRIVING DISPLAY PANEL AND DISPLAY APPARATUS APPLYING THE SAME

(75) Inventors: Sung-jin Lim, Suwon-si (KR); Gang-mo Koo, Suwon-si (KR); Sung-soo Kim, Suwon-si (KR); Kyu-chan Lee, Yongin-si (KR); Ho-seop Lee, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 180 days.

(21) Appl. No.: 13/441,352

(22) Filed: Apr. 6, 2012

(65) Prior Publication Data

US 2013/0076714 A1 Mar. 28, 2013

(30) Foreign Application Priority Data

Sep. 22, 2011 (KR) ..... 10-2011-0095902

(51) Int. Cl.

| | |
|---|---|
| ***G09G 3/00*** | (2006.01) |
| ***G09G 3/36*** | (2006.01) |
| ***G09G 3/20*** | (2006.01) |
| *G09G 3/34* | (2006.01) |

(52) U.S. Cl.

CPC ..... *G09G 3/003* (2013.01); *G09G 3/2096* (2013.01); *G09G 3/3648* (2013.01); *G09G 3/3406* (2013.01); *G09G 2310/0205* (2013.01); *G09G 2310/0224* (2013.01)

(58) Field of Classification Search

CPC . G09G 3/2011; G09G 3/2927; G09G 3/3614; G09G 3/3648

USPC ..... 345/208, 204, 690

See application file for complete search history.

(56) References Cited

U.S. PATENT DOCUMENTS

| | | | | |
|---|---|---|---|---|
| 6,680,722 | B1 * | 1/2004 | Hiraki et al. | 345/96 |
| 2003/0010894 | A1 | 1/2003 | Yoshihara et al. | |
| 2006/0125942 | A1 | 6/2006 | Hosaka et al. | |
| 2011/0169871 | A1 * | 7/2011 | Suzuki et al. | 345/690 |

FOREIGN PATENT DOCUMENTS

EP 1 367 557 A2 12/2003

OTHER PUBLICATIONS

Communication dated Oct. 1, 2012 issued by the European Patent Office in counterpart European Patent Application No. 12161439.0.
Communication dated Jun. 29, 2012 issued by the European Patent Office in counterpart European Application No. 12161439.0.
Communication dated Mar. 16, 2015 issued by the European Patent Office in counterpart European Patent Application No. 12161439.0.

* cited by examiner

*Primary Examiner* — Shaheda Abdin
(74) *Attorney, Agent, or Firm* — Sughrue Mion, PLLC

(57) ABSTRACT

A method for driving a display panel and a display apparatus applying the same are provided. The method includes driving all lines of the display panel in a first scanning section of a section to display one frame, and driving one of an even line and an odd line of the display panel in a second scanning section of the section to display the one frame. Accordingly, a crosstalk phenomenon in the display apparatus is removed and image quality of a 3D stereoscopic image is improved.

21 Claims, 6 Drawing Sheets

METHOD FOR DRIVING DISPLAY PANEL AND DISPLAY APPARATUS APPLYING THE SAME

CROSS-REFERENCE TO RELATED APPLICATION

This application claims priority from Korean Patent Application No. 10-2011-0095902, filed on Sep. 22, 2011, in the Korean Intellectual Property Office, the disclosure of which is incorporated herein by reference in its entirety.

BACKGROUND

1. Field

Methods and apparatuses consistent with exemplary embodiments relate to a method for driving a display panel and a display apparatus applying the same, and more particularly, to a method for driving a display panel of a display apparatus, which displays an image by providing backlight to the display panel, and a display apparatus applying the same.

2. Description of the Related Art

Since a display panel of the most commonly used display apparatus (for example, a liquid crystal display (LCD)) is not able to emit light by itself, the display apparatus requires a backlight unit to emit backlight to the display panel.

Such a display panel includes two display substrates and a liquid crystal layer interposed between the two substrates. That is, the display apparatus employing the backlight unit applies an electric field to the liquid crystal layer of the display panel and adjusts transmissivity of the backlight passing through the liquid crystal layer by adjusting a magnitude of the electric field, thereby displaying a desired image.

FIG. 1 is a view to explain a related-art method for driving a display panel. As shown in FIG. 1, the related-art display panel driving method drives all lines (1080 lines), from the first line ($0^{th}$ line) to the last line ($1079^{th}$ line), in sequence. That is, the related-art method drives the lines of each frame, from the first line to the last line, in sequence one by one, and constantly maintains the same control signal in each frame.

However, if an image is displayed in the related-art display panel driving method, the related-art method may cause a crosstalk phenomenon where an afterimage of a previous frame remains on an upper portion and a lower portion of a display screen due to a difference in scanning time and responding speed between a current frame (for example, a left-eye image) and the previous frame (for example, a right-eye image).

Therefore, there is a demand for a method for driving a display panel that can remove the crosstalk phenomenon.

SUMMARY

One or more exemplary embodiments may overcome the above disadvantages and other disadvantages not described above. However, it is understood that one or more exemplary embodiment are not required to overcome the disadvantages described above, and may not overcome any of the problems described above.

According to an aspect of an exemplary embodiment, there is provided a method for driving a display panel, which drives all lines of the display panel in a first scanning section of a section to display one frame and drives one of an even line and an odd line of the display panel in a second scanning section of the section to display the frame, and a display apparatus applying the same.

According to another aspect of an exemplary embodiment, there is provided a method for driving a display panel of a display apparatus, the method comprising: a first driving operation of driving all lines of the display panel in a first scanning section of a section to display one frame, and a second driving operation of driving one of an even line and an odd line of the display panel in a second scanning section of the section to display one frame.

The first driving operation may comprise driving all of the lines of the display panel by driving consecutive two lines simultaneously using one of even line data and odd line data to be applied to the display panel.

The section to display the frame may have a frequency of 120 Hz, and the first scanning section in which the first driving operation is performed may have a frequency of 240 Hz.

The first driving operation may comprise driving the even line of the display panel using even line data to be applied to the display panel and driving the odd line of the display panel using odd line data, and thus driving all of the lines of the display panel using data of all of the lines.

The section to display the frame may have a frequency of 120 Hz and the first scanning section in which the first driving operation is performed may have a frequency of 180 Hz.

The second driving operation may comprise applying one of even line data and odd line data to the display panel and driving only a line of the display panel corresponding to the applied line data.

The second driving operation may further comprise providing backlight to display an image on the display panel.

The method may further comprise: a third driving operation of driving all of the lines of the display panel in a first scanning section of a section to display a next frame of the frame, and a fourth driving operation of driving the other one of the even line and the odd line of the display panel in a second scanning section of the section to display the next frame.

The frame may be one of a left-eye image and a right-eye image of a 3D image, and the next frame may be the other one of the left-eye image and the right-eye image of the 3D image.

According to an aspect of another exemplary embodiment, there is provided a display apparatus comprising: a timing controller which generates a control signal to drive all lines of a display panel in a first scanning section of a section to display one frame and to drive one of an even line and an odd line of the display panel in a second scanning section of the section to display the frame, and the display panel which is driven using the control signal generated by the timing controller.

The timing controller may generate a control signal to drive all of the lines of the display panel by driving two consecutive lines simultaneously using one of even line data and odd line data to be applied to the display panel in the first scanning section.

The section to display the frame may have a frequency of 120 Hz and the first scanning section in which a first driving operation is performed may have a frequency of 240 Hz.

The timing controller may generate a control signal to drive all of the lines of the display panel by driving the even line of the display panel using even line data and driving the odd line of the display panel using odd line data in the first scanning section.

The section to display the frame may have a frequency of 120 Hz and the first scanning section in which the first driving operation is performed may have a frequency of 180 Hz.

The timing controller may generate a control signal to apply one of even line data and odd line data to the display panel in the second scanning section and to drive only a line of the display panel corresponding to the applied line data.

The display apparatus may further comprise a backlight unit which provides backlight to the display panel in the second scanning section.

The timing controller may generate a control signal to drive all of the lines of the display panel in a first scanning section of a section to display a next frame of the frame and to drive the other one of the even line and the odd line of the display panel in a second scanning section of the section to display the next frame.

The frame may be one of a left-eye image and a right-eye image of a 3D image, and the next frame may be the other one of the left-eye image and the right-eye image of the 3D image.

Additional aspects and advantages of the exemplary embodiments will be set forth in the detailed description, will be obvious from the detailed description, or may be learned by practicing the exemplary embodiments.

BRIEF DESCRIPTION OF THE DRAWING FIGURES

The above and/or other aspects will be more apparent by describing in detail exemplary embodiments, with reference to the accompanying drawings, in which.

DETAILED DESCRIPTION OF THE EXEMPLARY EMBODIMENTS

Figure 1:
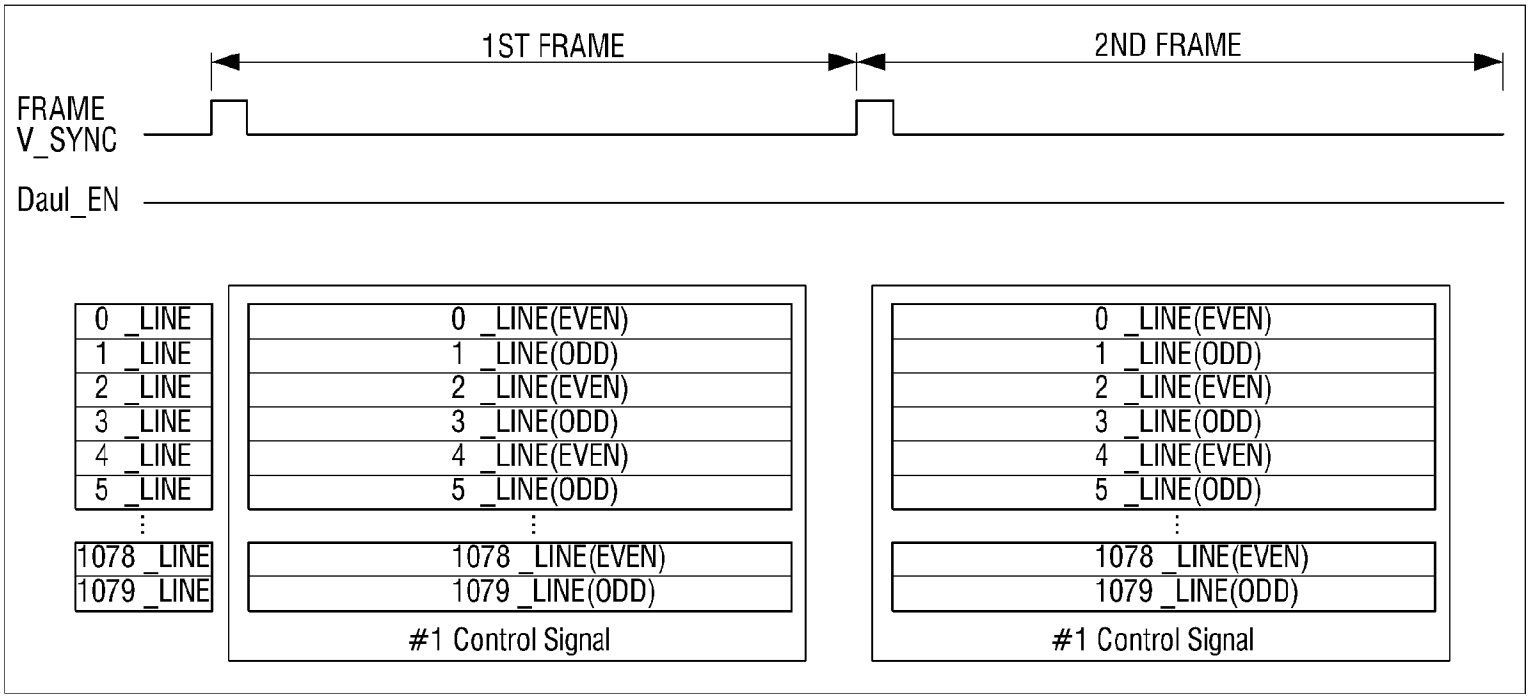
FIG. 1 RELATED ART
FIG. 1 is a view to explain a related-art method for displaying a display panel.

Hereinafter, exemplary embodiments will be described in greater detail with reference to the accompanying drawings.

In the following description, same reference numerals are used for the same elements when they are depicted in different drawings. The matters defined in the description, such as detailed construction and elements, are provided to assist in a comprehensive understanding of the exemplary embodiments. Thus, it is apparent that the exemplary embodiments can be carried out without those specifically defined matters. Also, functions or elements known in the related art are not described in detail since they would obscure the exemplary embodiments with unnecessary detail.

Figure 2:
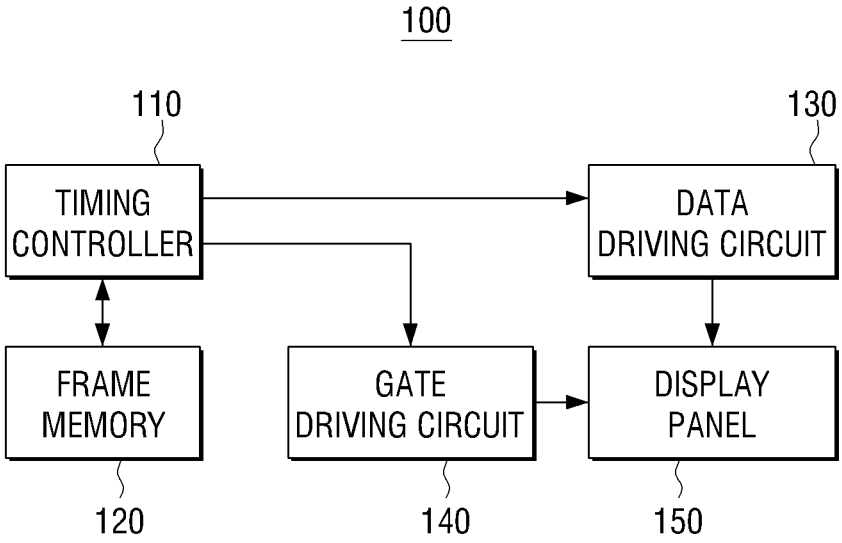
FIG. 2 is a block diagram illustrating a display apparatus according to an exemplary embodiment.

FIG. 2 is a block diagram illustrating a display apparatus according to an exemplary embodiment. As shown in FIG. 2, a display apparatus 100 comprises a timing controller 110, a frame memory 120, a data driving circuit 130, a gate driving circuit 140, and a display panel 150.

The timing controller 110 receives an RGB image signal (R, G, B) from a graphic controller (not shown) and receives an input control signal to control display of the RGB image signal, for example, a vertical sync signal (Vsync) and a horizontal sync signal (Hsync), a main clock signal (MCLK), and a data enable signal (DE). If the timing controller 110 receives an image frame (Gn) from the external graphic controller, the timing controller 110 reads out a previous image frame (Gn−1) pre-stored in the frame memory 120 and stores the current image frame (Gn) in the frame memory 120.

The timing controller 110 generates a control signal including a gate control signal and a data control signal based on the input control signal. At this time, the timing controller 110 appropriately processes the RGB image signal (R, G, B) according to an operating condition of the display panel 150, and then provides the data control signal and the processed image data to the data driving circuit 130 and provides the gate control signal to the gate driving circuit 140.

At this time, the image data is divided into even line data to be applied to an even line electrode of the display panel 150 and odd line data to be applied to an odd line electrode, and is provided to the data driving circuit 130.

The data control signal comprises a horizontal sync start signal (STH) to instruct a start of input of the image data, a load signal (LOAD) to apply a corresponding data voltage to a data line, a reverse signal (RVS) to reverse a polarity of a data voltage with respect to a common voltage, and a data clock signal (HCLK).

The gate control signal comprises a vertical sync start signal (STV) to instruct a start of output of a gate on pulse (a gate on voltage range), a gate clock signal (CPV) to control an outputting time of the gate on pulse, and an output enable signal (OE) to limit a width of the gate on pulse. Among these signals, the output enable signal (OE) and the gate clock signal (CPV) are provided to a driving voltage generator (not shown) of the gate driving circuit.

Particularly, the timing controller 110 generates a control signal to drive all lines of the display panel 150 in a first scanning section of a section to display one frame and to drive one of an even line and an odd line of the display panel 150 in a second scanning section of the section to display the frame. This will be explained in detail below with reference to FIGS. 3 to 5B.

The data driving circuit 130 is connected to a data line of the display panel 150, generates a plurality of gray voltages based on a plurality of gamma voltages provided from a gamma voltage generator (not shown), and selects a gray voltage generated as a data signal and applies the gray voltage to a unit pixel. The plurality of gamma voltages generated by the gamma voltage generator are two pairs of gamma voltages that are related to transmissivity of the unit pixel. One pair of gamma voltages is a positive polarity data voltage and the other pair is a negative polarity data voltage. The positive polarity data voltage and the negative polarity data voltage are data voltages having opposite polarities with respect to the common voltage (Vcom) and are provided to the display panel 150 alternately during reversal driving.

The gate driving circuit 140 is connected to a gate line of the display panel 150 and applies a gate signal combining a gate on voltage (Von) and a gate off voltage (Voff) applied from an external source to the gate line. The gate driving circuit 140 receives the gate clock signal (CPV) combining a gate on signal and a gate off signal and the output enable signal (OE) to adjust a width of the gate on signal.

The display panel 150 comprises a plurality of pixels. The plurality of pixels respond to a plurality of gate signals in sequence on a row basis and apply the plurality of data signals to a corresponding pixel row. Accordingly, each pixel row is charged with the plurality of data voltages and light transmissivity of a liquid crystal layer is controlled according to the level of the charged voltages.

At this time, the display panel 150 requires a backlight unit (not shown) to provide backlight to the display panel 150 in order to display a desired image for a user. According to an exemplary embodiment, the backlight unit may provide backlight only in an interlace scanning section of the section to display the frame. This will be explained in detail below with reference to FIGS. 3 and 4.

Hereinafter, a method for driving a display panel according to exemplary embodiments will be explained in detail with reference to FIGS. 3 to 5C.

Figure 3:
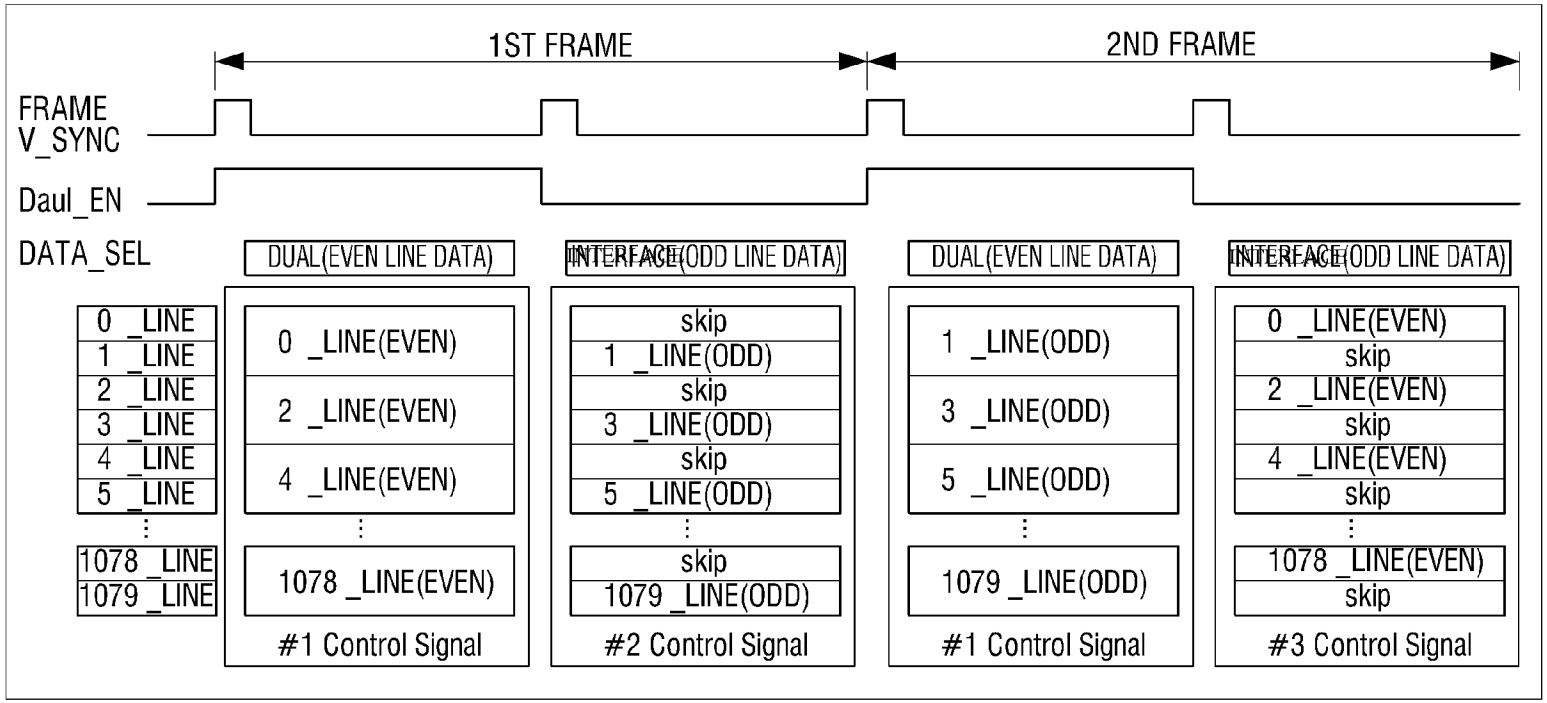
FIG. 3 is a view to explain a method for driving a display panel according to an exemplary embodiment.

FIG. 3 is a view to explain a method for driving a display panel 150 according to an exemplary embodiment.

As shown in FIG. 3, the timing controller 120 generates a control signal to divide a section in which a first frame is displayed into two sections and drive the first frame. The two sections are a dual scanning section and an interlace scanning section and are distinguished from each other by a vertical sync signal (V_sync).

Specifically, the timing controller 110 generates a control signal to drive all lines of the display panel 150 by driving two consecutive lines simultaneously using one of even line data and odd line data to be applied to the display panel in the dual scanning section. For example, as shown in FIG. 3, the timing controller 110 drives all of the lines ($0^{th}$ line~$1079^{th}$ line) of the display panel 150 by driving two consecutive lines simultaneously using the even line data in the dual scanning section.

Figure 5A:
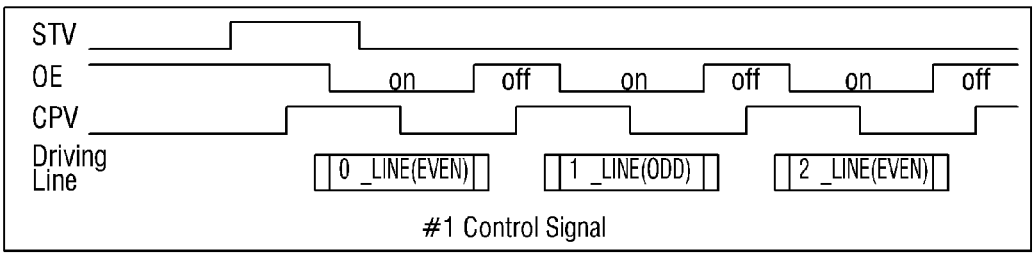
FIGS. 5A to 5C are views to explain a control signal to control a display panel according to an exemplary embodiment.

More specifically, the timing controller 110 applies the even line data to the data driving circuit 130 in the dual scanning section of the first frame, and applies a first gate signal to turn on not only the even line but also the odd line and a dual enable signal (Dual_EN) to display the even line data on not only the even line but also the odd line to the gate driving circuit 140, as shown in FIG. 5A. Accordingly, in the dual scanning section of the first frame, the $0^{th}$ line data is scanned on not only the $0^{th}$ line but also the $1^{st}$ line and the $2^{nd}$ line data is scanned on not only the $2^{nd}$ line but also the $3^{rd}$ line. In this manner, all of the lines of the display panel 150 are scanned.

The timing controller 110 generates a control signal to drive only one of the even line and the odd line of the display panel 150 in the interlace scanning section of the first frame. For example, as shown in FIG. 3, the timing controller 110 drives only the odd line of the display panel 150 using the odd line data in the interlace scanning section of the first frame.

Figure 5B:
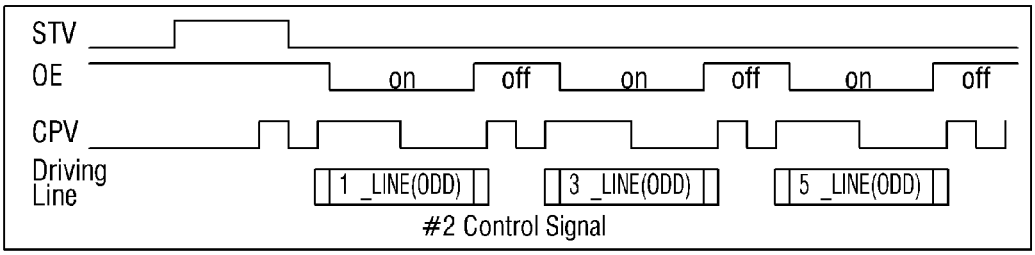

More specifically, the timing controller 110 applies the odd line data to the data driving circuit 130 in the interlace scanning section of the first frame and applies a second gate signal to turn on the odd line to the gate driving circuit 140 as shown in FIG. 5B. Accordingly, in the interlace scanning section of the first frame, the $0^{th}$ line is skipped, the $1^{st}$ line is driven by the $1^{st}$ line data, the $2^{nd}$ line is skipped, and the $3^{rd}$ line is driven by the $3^{rd}$ line data. In this manner, only the odd lines of the display panel 150 are scanned.

In this case, one frame may have a frequency of 120 Hz and each of the dual scanning section and the interlace scanning section may have a frequency of 240 Hz. However, this should not be considered as limiting. If the dual scanning section is a half of the section in which one frame is displayed, one technical idea of the present disclosure can be applied.

As described above, one frame is divided into two sections, and the display panel 150 is driven with one of the even line data and the odd line data in the dual scanning section and is driven with only one of the even line data and the odd line data that is different from that used in the dual scanning section in the interlace scanning section, so that an amount of output data is not changed compared to an amount of input data and thus an image of original image quality can be viewed Also, since the dual scanning section is a pre-charge section and the backlight is provided to only the interlace scanning section, a crosstalk phenomenon where an afterimage remains can be removed.

A section in which a second frame which is a next frame of the first frame is displayed is also divided into two sections. In the section in which the second frame is displayed, the display panel 150 may be operated in the same way as in the section in which the first frame is displayed. However, in the section in which the second frame is displayed, even line data and odd line data may be scanned according to four exemplary embodiments as shown in table 1:

| Frame | First Frame | | Second Frame | |
|---|---|---|---|---|
| Scanning Section | Dual | Interlace | Dual | Interlace |
| First Embodiment | Even Line | Odd Line | Even Line | Odd Line |
| Second Embodiment | Even Line | Odd Line | Odd Line | Even Line |
| Third Embodiment | Odd Line | Even Line | Even Line | Odd Line |
| Fourth Embodiment | Odd Line | Even Line | Odd Line | Even Line |

Figure 4:
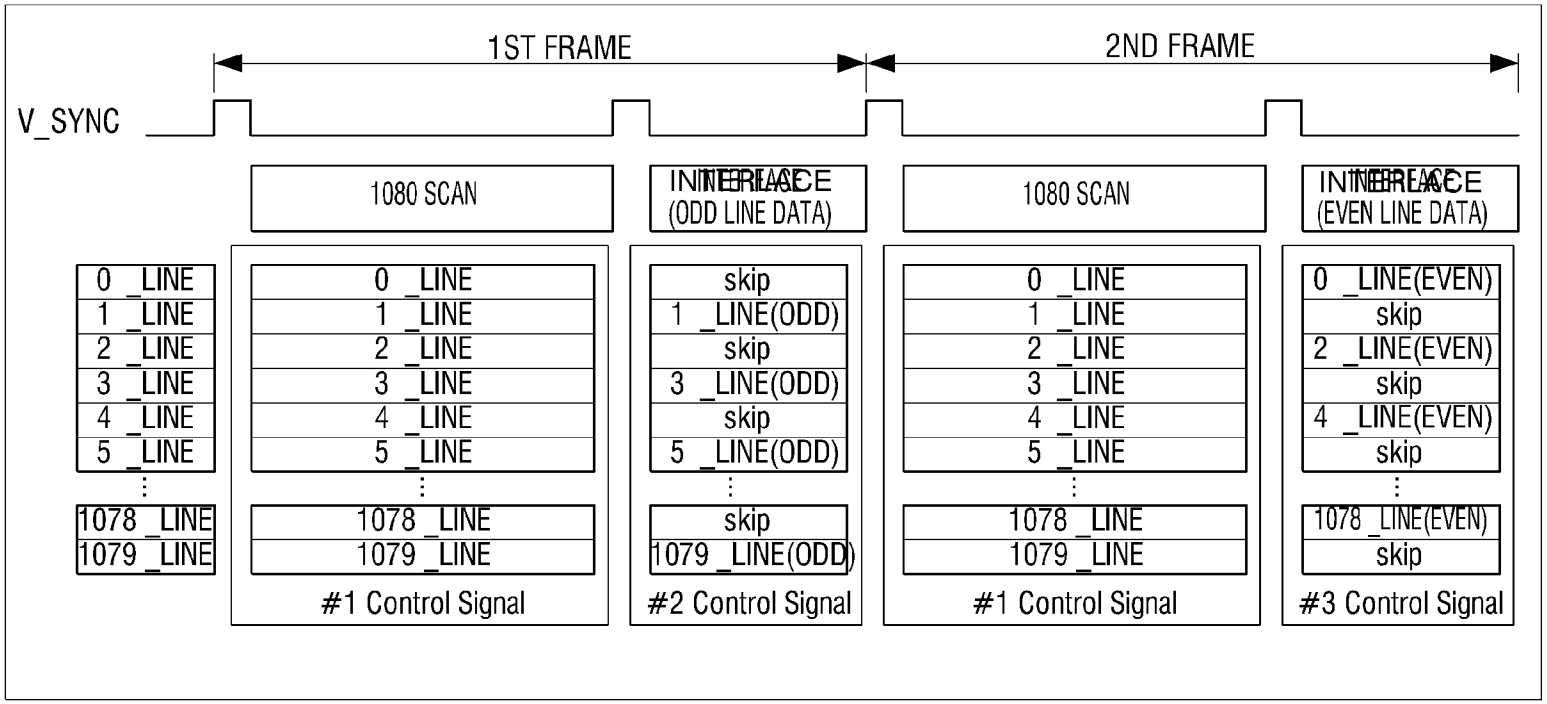
FIG. 4 is a view to explain a method for driving a display panel according to another exemplary embodiment.

FIG. 4 is a view to explain a method for displaying a display panel according to another exemplary embodiment.

Like in the exemplary embodiment of FIG. 3, the timing controller 110 generates a control signal to divide a section in which a first frame is displayed into two sections and drive the first frame as shown in FIG. 4. The two sections are a full scanning section and an interlace scanning section and are distinguished from each other by a vertical sync signal (V_sync).

Specifically, the timing controller 110 generates a control signal to drive all lines of the display panel 150 in the full scanning section of the first frame. That is, the timing controller 110 generates a control signal to drive an even line of the display panel 150 using even line data of the first frame and to drive an odd line of the display panel 150 using odd line data of the first frame.

The timing controller 110 generates a control signal to drive only one of the even line and the odd line of the display panel 150 in the interlace scanning section of the first frame. For example, as shown in FIG. 4, the timing controller 110 drives only the odd line of the display panel 150 using the odd line data in the interlace scanning section of the first frame.

More specifically, the timing controller 110 applies the odd line data to the data driving circuit 130 in the interlace scanning section of the first frame, and applies the second gate signal to turn on the odd line to the gate driving circuit 140, as shown in FIG. 5B. Accordingly, the $0^{th}$ line is skipped in the interlace scanning section of the first frame, the $1^{st}$ line is driven by the $1^{st}$ line data, the $2^{nd}$ line is skipped, and the $3^{rd}$ line is driven by the $3^{rd}$ line data. In this manner, only the odd lines of the display panel 150 are scanned.

The timing controller 110 generates a control signal to drive all of the lines of the display panel 150 in a full scanning section of a second frame. That is, the timing controller 110 generates a control signal to drive the even line of the display panel 150 using even line data of the second frame and to drive the odd line of the display panel 150 using odd line data of the second frame.

The timing controller 110 generates a control signal to drive only one of the even line and the odd line of the display panel 150 that is different from that used in the interlace scanning section of the first frame in the interlace scanning section of the second frame. For example, as shown in FIG. 4, the timing controller 110 drives only the even line of the display panel 150 using the even line data in the interlace scanning section of the second frame.

Figure 5C:
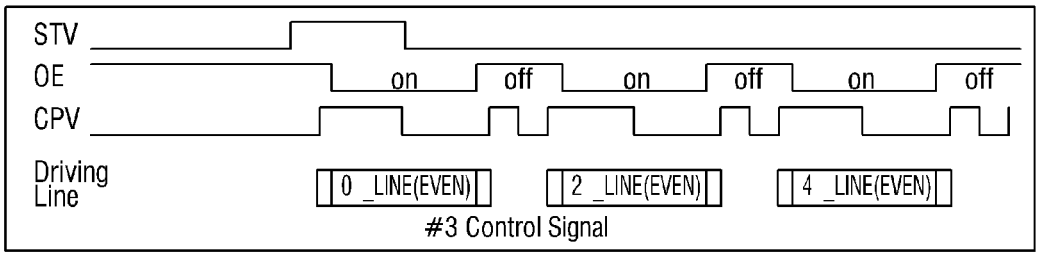

More specifically, the timing controller 140 applies the even line data to the data driving circuit 130 in the interlace scanning section of the second frame, and applies a third gate signal to turn on the even line to the gate driving circuit 140 as shown in FIG. 5C. Accordingly, in the interlace scanning section of the second frame, the $0^{th}$ line is driven by the $0^{th}$ line data, the $1^{st}$ line is skipped, the $2^{nd}$ line is driven by the $2^{nd}$ line data, and the $3^{rd}$ line is skipped. In this manner, only the odd lines of the display panel 150 are scanned.

In this case, one frame may have a frequency of 120 Hz and the full scanning section and the interlace scanning section may have a frequency of 180 Hz and a frequency of 360 Hz, respectively. However, this should not be considered as limiting. One technical idea of the present disclosure may be applied to a full scanning section and an interlace scanning section of different frequencies.

As described above, one frame is divided into two sections and the display panel 150 is driven using data of all of the lines in the full scanning section and is driven using only one of the even line and the odd line in the interlace scanning section, so that an amount of output data is not changed compared to an amount of input data and thus an image of original image quality can be viewed.

Also, since the full scanning section is a charge section and the backlight is provided to only the interlace scanning section, a crosstalk phenomenon where an afterimage remains can be removed.

The exemplary embodiments of FIGS. 3 and 4 may be applied if the display apparatus is an apparatus to display a 3D stereoscopic image. In this case, the first fame is one of a left-eye image and a right-eye image of the 3D stereoscopic image and the second frame is the other one of the left-eye image and the right-eye image of the 3D stereoscopic image that is different from that of the first frame.

If a 3D image is displayed in the method explained in FIGS. 3 and 4, a crosstalk phenomenon where an afterimage of a right-eye image appears when a left-eye image is displayed and an afterimage of the left-eye image appears when the right-eye image is displayed can be prevented.

Figure 6:
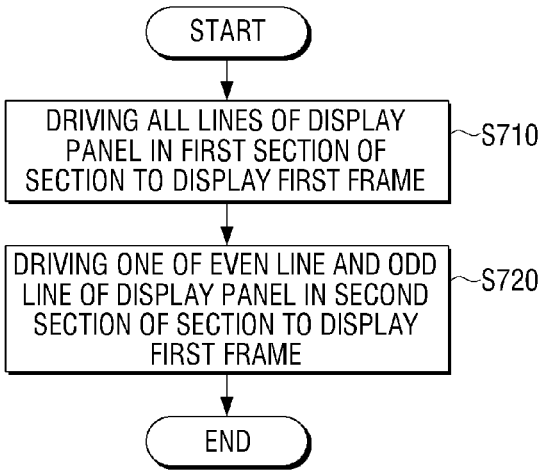
FIG. 6 is a flowchart illustrating a method for driving a display panel according to an exemplary embodiment.

Hereinafter, a method for driving a display panel according to an exemplary embodiment will be explained with reference to FIG. 6.

First, the display apparatus drives all lines of the display panel 150 in a first section of a section in which a first frame is displayed (S710).

Specifically, as shown in FIG. 3, the display apparatus drives two consecutive lines simultaneously using one of even line data and odd line data of the display panel 150, thereby driving all of the lines of the display panel 150. According to another exemplary embodiment, as shown in FIG. 4, the display apparatus may drive the even line using the even line data of the display panel 150 and drive the odd line using the odd line data.

The display apparatus drives one of the even line and the odd line of the display panel 150 in a second section of the first frame (S720).

In the exemplary embodiment of FIG. 3, the display apparatus scans only one of the even line and the odd line of the display panel using line data other than the line data used in the first section. For example, in the exemplary embodiment of FIG. 3, if the display apparatus uses the odd line data in the first section, the display apparatus drives only the even line in the second section. Also, in the exemplary embodiment of FIG. 4, the display apparatus scans only one of the even line and the odd line of the display panel using line data other than the line data used in the second section of the previous frame. For example, in the exemplary embodiment of FIG. 4, if the display apparatus drives only the odd line of the display panel 150 in the second section of the previous frame, the display apparatus drives only the even line of the display panel 150 in the second section of the current frame.

As described above, the section to display one frame is divided into the two sections so that a crosstalk phenomenon can be removed and a high quality image can be provided.

Besides the method in which only one of the even line and the odd line of the display panel 150 is scanned in the interlace scanning section described above in FIGS. 3 and 4, the technical idea of the present disclosure may be applied to a method in which only one of the even line and the odd line is scanned by applying a specific signal for interlace scanning to the gate driving circuit 140.

The foregoing exemplary embodiments and advantages are merely exemplary and are not to be construed as limiting the present inventive concept. The exemplary embodiments can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A method for driving a display panel of a display apparatus, the method comprising:

a first driving operation of driving all lines of the display panel in a first scanning section of a section to display one frame; and a second driving operation of driving only one of an even line and an odd line of the display panel in a second scanning section of the section to display the one frame, wherein the section to display the one frame is a driving section.

2. The method as claimed in claim 1, wherein the first driving operation comprises driving all of the lines of the display panel by driving two consecutive lines simultaneously using one of even line data and odd line data to be applied to the display panel.

3. The method as claimed in claim 2, wherein the section to display the one frame has a frequency of 120 Hz, and the first scanning section in which the first driving operation is performed has a frequency of 240 Hz.

4. The method as claimed in claim 1, wherein the first driving operation comprises driving the even line of the display panel using even line data to be applied to the display panel and driving the odd line of the display panel using odd line data, and thus driving all of the lines of the display panel using data of all of the lines.

5. The method as claimed in claim 4, wherein the section to display the frame has a frequency of 120 Hz and the first scanning section in which the first driving operation is performed has a frequency of 180 Hz.

6. The method as claimed in claim 1, wherein the second driving operation comprises applying one of even line data and odd line data to the display panel and driving only a line of the display panel corresponding to the applied line data.

7. The method as claimed in claim 1, wherein the second driving operation further comprises providing backlight to display an image on the display panel.

8. The method as claimed in claim 1, further comprising:

a third driving operation of driving all of the lines of the display panel in a first scanning section of a section to display a next frame; and a fourth driving operation of driving the other one of the even line and the odd line, being the line not driven by the second driving operation, of the display panel in a second scanning section of the section to display the next frame.

9. The method as claimed in claim 8, wherein the frame is one of a left-eye image and a right-eye image of a 3D image, wherein the next frame is the other one of the left-eye image and the right-eye image of the 3D image.

10. A display apparatus comprising:

a timing controller which generates a control signal to drive all lines of a display panel in a first scanning section of a section to display one frame and to drive only one of an even line and an odd line of the display panel in a second scanning section of the section to display the one frame; and the display panel which is driven using the control signal generated by the timing controller, wherein the section to display the one frame is a driving section.

11. The display apparatus as claimed in claim 10, wherein the timing controller generates a control signal to drive all of the lines of the display panel by driving two consecutive lines simultaneously using one of even line data and odd line data to be applied to the display panel in the first scanning section.

12. The display apparatus as claimed in claim 11, wherein the section to display the frame has a frequency of 120 Hz and the first scanning section in which a first driving operation is performed has a frequency of 240 Hz.

13. The display apparatus as claimed in claim 10, wherein the timing controller generates a control signal to drive all of the lines of the display panel by driving the even line of the display panel using even line data and driving the odd line of the display panel using odd line data in the first scanning section.

14. The display apparatus as claimed in claim 13, wherein the section to display the frame has a frequency of 120 Hz and the first scanning section in which the first driving operation is performed has a frequency of 180 Hz.

15. The display apparatus as claimed in claim 10, wherein the timing controller generates a control signal to apply one of even line data and odd line data to the display panel in the second scanning section and to drive only a line of the display panel corresponding to the applied line data.

16. The display apparatus as claimed in claim 10, further comprising a backlight unit which provides backlight to the display panel in the second scanning section.

17. The display apparatus as claimed in claim 10, wherein the timing controller generates a control signal to drive all of the lines of the display panel in a first scanning section of a section to display a next frame and to drive the other one of the even line and the odd line of the display panel in a second scanning section of the section to display the next frame.

18. The display apparatus as claimed in claim 17, wherein the frame is one of a left-eye image and a right-eye image of a 3D image, wherein the next frame is the other one of the left-eye image and the right-eye image of the 3D image.

19. A method for driving a display panel of a display apparatus, the method comprising:

driving all lines of the display panel in a first scanning section of a first frame; and driving only one of an even line and an odd line of the display panel in a second scanning section of the first frame following the first scanning section of the first frame.

20. The method as claimed in claim 19, wherein all of the lines of the display panel in the first scanning section are driven by driving two consecutive lines simultaneously using one of even line data and odd line data applied to the display panel.

21. A method for driving a display panel of a display apparatus, the method comprising:

a first driving operation of driving two consecutive lines of only an even line or an odd line of the display panel in a first scanning section of a first section to display a first frame;

a second driving operation of driving only one of an even line and an odd line of the display panel in a second scanning section of the first section to display the second frame;

a third driving operation of driving two consecutive lines of only the even line or the odd line not driven in the first driving operation of a second section to display a second frame; and a fourth driving operation of driving only one of the even line and the odd line not driven in the second driving operation of the second section to display the second frame, wherein the first section and the second section are driving sections, and wherein the second frame is driven after the first frame.

* * * * *